United States Patent [19]

Dammann et al.

[11] 4,377,932

[45] Mar. 29, 1983

[54] FLEXIBLE BELT YARN FALSE TWISTING APPARATUS

[75] Inventors: Peter Dammann; Heinz Schippers; Karl Bauer, all of Remscheid-Lennep, Fed. Rep. of Germany

[73] Assignee: Barmag Barmer Maschinenfabrik AG, Remscheid, Fed. Rep. of Germany

[21] Appl. No.: 219,329

[22] Filed: Dec. 22, 1980

Related U.S. Application Data

[63] Continuation-in-part of Ser. No. 168,735, Jul. 14, 1980, abandoned.

[30] Foreign Application Priority Data

Jul. 14, 1979 [DE] Fed. Rep. of Germany ..... 2928522
Dec.24, 1979 [DE] Fed. Rep. of Germany ..... 2952305
Mar. 4, 1980 [DE] Fed. Rep. of Germany ..... 3008233

[51] Int. Cl.[3] ..... D02G 1/04; D01H 7/92
[52] U.S. Cl. ..... 57/336; 57/348
[58] Field of Search ..... 57/334-340, 57/348, 349

[56] References Cited

U.S. PATENT DOCUMENTS

| | | | |
|---|---|---|---|
| 2,863,280 | 12/1958 | Ubbelohde | 57/336 X |
| 2,991,614 | 7/1961 | Ubbelohde | 57/336 |
| 3,045,416 | 7/1962 | Ubbelohde | 57/336 X |
| 3,373,554 | 3/1968 | Raschle | 57/340 |
| 4,047,373 | 9/1977 | Takai | 57/336 |
| 4,144,700 | 3/1979 | Takai et al. | 57/336 X |
| 4,144,701 | 3/1979 | Takai et al. | 57/336 |

FOREIGN PATENT DOCUMENTS

| | | |
|---|---|---|
| 19562 | 11/1980 | European Pat. Off. . |
| 278535 | 1/1952 | Switzerland . |
| 586296 | 6/1975 | Switzerland . |

OTHER PUBLICATIONS

Murata Machinery, Ltd. Brochure Entitled "Murata No. 333 II Mach Crimper", 12 pages.

*Primary Examiner*—John Petrakes
*Attorney, Agent, or Firm*—Bell, Seltzer, Park & Gibson

[57] ABSTRACT

An apparatus for false twisting a yarn is provided which comprises, in one embodiment, a pair of endless belts mounted for rotation to define a twisting zone between opposing friction surfaces thereof. A pressure applying member is mounted adjacent the back side of each belt for biasing the belts toward each other locally at the twisting zone so as to firmly engage the yarn passing through the twisting zone and while the friction surfaces remain in substantially non-contacting relationship with respect to each other. The pressure applying member preferably utilizes an air cushion between the member and back side of the belt to minimize friction. In another embodiment, the apparatus comprises an endless belt in association with a disc mounted for rotation about an axis disposed perpendicular to the runs of the belt, and in a further embodiment, the endless belt is associated with a roller mounted adjacent the runs of the belt.

46 Claims, 43 Drawing Figures

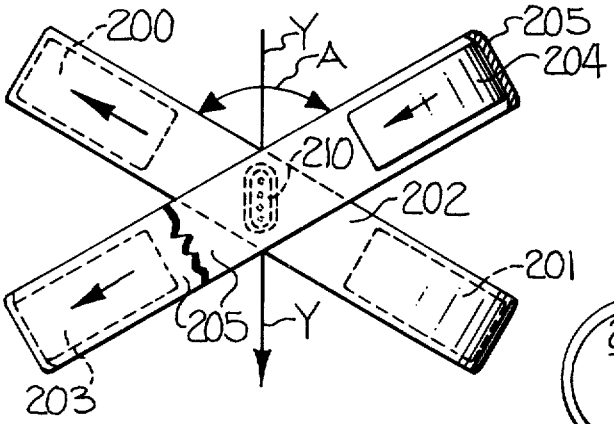
Fig-15
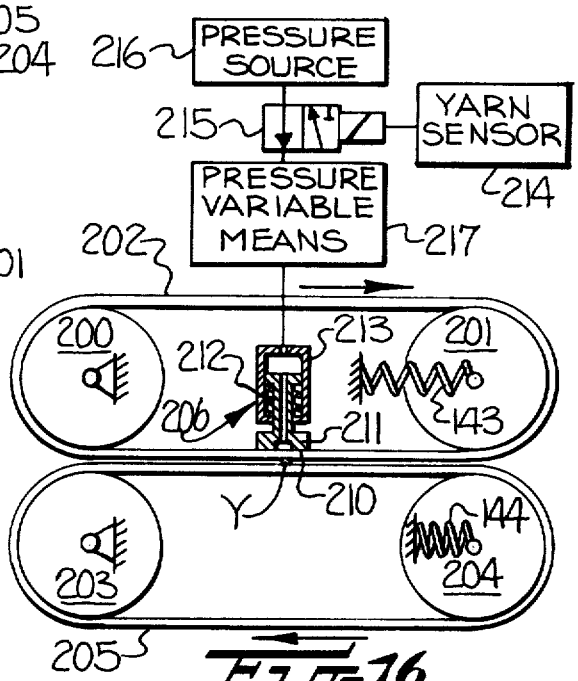
Fig-16
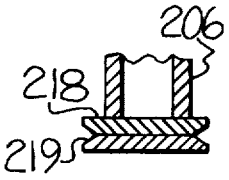
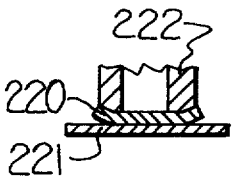
Fig-17a Fig-17b
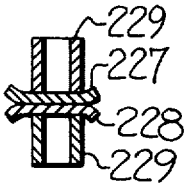
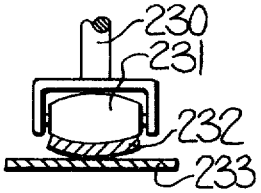
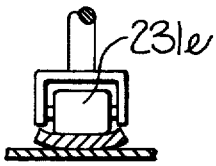
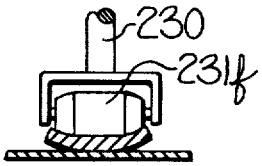
Fig-17c Fig-17d Fig-17e Fig-17f
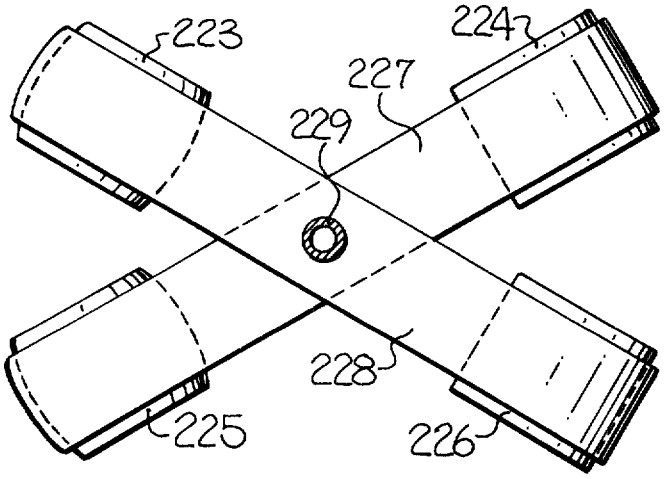
Fig-18

FLEXIBLE BELT YARN FALSE TWISTING APPARATUS

This is a continuation in part of copending application, Ser. No. 06/168,735 filed July 14, 1980 and now abandoned.

The present invention relates to an apparatus for twisting or texturing textile filament yarns. The invention particularly relates to the action of revolving friction work surfaces moving in opposite directions or crossing each other, which friction surfaces contact the circumference of one or several textile filaments or yarns running therebetween, to both twist and advance the yarns by direct frictional contact. More particularly, the present invention relates to the design and construction of a pressure apparatus for devices adapted to texturize textile filament yarns according to the principle of imparting twist by direct frictional contact between two friction surfaces.

Apparatus for texturizing textile yarns of the above described type and which comprise flat, crossed belts are disclosed in Swiss Patent Specification No. 278,535, as well as U.S. Pat. Nos. 2,863,280 and 2,991,614, and German OLS No. 26 28 396.

In order to obtain proper texturing and an even twist distribution in the yarn, the manner in which the pressure is applied and the design of the pressure zone is of critical importance. Thus in known apparatus operating with flat crossed belts, and which are conducted under tension and with little mutual contact, it is found that the belts are only supported and pressed against each other along their edges, which is disadvantageous in that excessive wear occurs along the edges of the belts, and the yarn may be damaged.

Supporting rollers for pressing the belts toward each other, as disclosed for example in Swiss Patent Specification No. 278,535, or pressure plates employed for this purpose, see U.S. Pat. No. 2,991,614 at FIG. 5, have the disadvantage that the supporting areas of the belts are crossed in relation to the yarn nipping or twisting zone, and the supporting rollers must be arranged perpendicularly to the running direction of the belts so as not to displace the belts from their running plane. This results in a short nip length, which is not sufficient to impart the desired high twist. Also, only at a technically unrealistic ratio of roller diameter and belt width is it possible to obtain satisfactory results and an adequate nip of the yarn.

It will also be appreciated that supporting rollers as described above are driven on their circumference by contact with the rapidly moving belt, and therefore must be accurately mounted in high speed bearings. Further, when the assemblies are either started or stopped, high acceleration forces must be applied due to their mass moment of inertia.

The objects of the invention are to obtain a better and more uniform textured yarn, to improve the pressure contact of the work surfaces effecting direct frictional contact on the yarn, and to provide a more effective twisting zone in an apparatus of the described type.

These and other objects and advantages are achieved in the embodiments illustrated herein by the provision of a pair of twist imparting members, with at least one of the members comprising a relatively thin endless belt having inner and outer faces. The members are mounted for rotation so that portions of the faces thereof define a twisting zone therebetween, and pressure forces are locally applied to one of the belt faces only at the twisting zone to bias the belt toward the other member, and such that a yarn may be moved through the twisting zone while having twist imparted thereto by frictional contact with the two members, and while the yarn engaging friction surfaces of the members remain in substantially non-contacting relationship with respect to each other. The pressure force is applied by a member which preferably includes a relatively long and narrow pressure surface disposed adjacent the face of the belt, and which is aligned with the length and width of the path of the yarn through the twisting zone.

In one embodiment of the invention, the other twist imparting member comprises a second like endless belt which is mounted in crossing relation with respect to the first mentioned belt, and there is provided a second like biasing member mounted adjacent the inner face of the second belt in a mirror image of the first mentioned biasing member. In another embodiment of the invention, the other twist imparting member comprises a rigid, substantially non-yielding circular disc mounted for rotation about an axis disposed perpendicular to the runs of the endless belt. In a further embodiment, the other twist imparting member comprises a cylindrical roller mounted for rotation about an axis disposed parallel to the planes of the runs of the endless belt.

The pressure forces are transferred directly to the belt with low inertia and little friction. In a preferred embodiment, the pressure forces are transferred by means of a fluid pressure applying member, and without use of a rotating roller or the like which would need to be accelerated. Yet another advantage is that wear between the pressure applying member and the belt is minimized by utilizing a fluid cushion on the adjacent face of the belt. In this embodiment, pressure is applied by the force of an outflowing pressure fluid, assisted if desired by static pressure forces, and the pressure applying member does not contact the work surface at all, so that there is no wear. Advantages also result in that the pressure zone can be readily adapted to the structural conditions of the apparatus, by means of selective geometrical profiling of the pressure member, and the magnitude of force can be readily adjusted to the desired parameters of the texturing process, such as denier, twist level, belt and yarn speeds, by controlling the pressure and amount of the fluid. This is particularly the case due to the elastic deformability of the work surface, and since a defined pressure or twisting zone is created, which is easily conformable to the yarn nip line.

The pressure applying member according to the invention is preferably designed and constructed as a cylinder-piston assembly, with the piston being actuated by pressurized air. In one embodiment, the piston has an insert body made of a material with a low friction coefficient. In an advantageous further embodiment of the apparatus, this insert body, which geometrically defines the twisting zone, may be porous and be lubricated through a longitudinal bore in the piston by a suitable gaseous or liquid pressure fluid to further reduce friction and wear.

In another embodiment of the pressure applying member, the insert is omitted, and pressurized air acts directly on the inner face of the belt, in order to press the belt locally against the filament yarn. The pressurized air forms a cushion, which is built up between the lower free end of the piston and the work surface, and effects the required pressure of contact between the yarn and the two opposing friction surfaces.

The pneumatic lubrication between the pressure surface of the piston and the work surface is particularly advantageous, in that little force is required to apply the pressure, and wear is substantially avoided by the non-contact transfer of the biasing force. It should be also noted that the pressure applying member is essentially insensitive to unevenness of the running surface of the belt, and readily absorbs shocks. Thus the surface properties of the inner face of the belt are relatively unimportant.

In another aspect of the invention, an endless flat belt is tensioned between rotatably driven mounting rollers, and locally biased by means of a pressure applying member as described above, while nipping the yarn against the surface of a rotatably driven rigid work surface, such as a back-up roller or the like. The advantage of this arrangement is that fewer structural parts susceptible to breakdown are required, and one of the flexible work surfaces, namely, one of the belt assemblies, is no longer needed. Thus, only one pressure applying member and associated air control system is required. Also the number of belt assemblies fatiguing during long periods of operation on a machine is reduced, and thus the time used to correct breakdowns and failures of the assemblies during the production process may be reduced.

In order to be able to adapt the work surfaces formed by the back-up roller or the like to the different requirements of the texturing process, the roller may be pivotally mounted and adjustable with respect to its crossing angle of the threadline, this angle being defined between the threadline and a plane normal to the rotary shaft of the roller. Alternatively, the belt assembly may be adjustably arranged with respect to the angle at which it crosses the threadline.

The rigid back-up roller is preferably either shaped as a cylinder, or a truncated cone. To permit adaptation to an optimal yarn nip line, it may also have the shape of an exact or approximate rotating hyperboloid. The geometrical form of the surface of the rotating hyperboloid is preferably adapted to an average crossing angle between the work surfaces provided for the operation of the texturing apparatus, and the contact pressure surface of the pressure applying member is convexly curved in a conforming manner.

According to another embodiment of the apparatus, having one work surface in the form of a flexible belt which cooperates with the surface of a rigid roller, the mounting rollers for the belt have a larger diameter than that of the rigid back-up roller. Thus, the back-up roller may be located in the space enclosed by the two mounting rollers and the inner surface of the belt. The inner surface of the belt is locally biased with little friction against the surface of the back-up roller by means of a pressure applying member as described above.

The present invention also permits the efficient mounting of a plurality of twisting apparatus in a side by side arrangement on a multi-station false twist machine. In such case, it is advantageous to have the back-up roller of each twisting station coaxially arranged on and driven by a common shaft extending horizontally across a section or the entire machine length. This arrangement simplifies the mounting and drive of the friction assemblies. Also, the belts are preferably individually adjustable with respect to their respective yarn crossing angle, and the yarn guides are located in such a manner that they guide the yarn along the intended yarn nip line. Typically, the yarn guides are arranged in such a manner that they guide the yarn along the bisecting line of the crossing angle between the two cooperating work surfaces.

In a further embodiment, only one of a pair of belts is provided with a pressure apparatus, and the other back-up belt is made as resistant to slackening as possible. This may be accomplished by increased tensioning of the back-up belt and by reducing the center to center distance between the two mounting rollers of the back-up belt, or by conducting the back-up belt over a supporting roller positioned in the area of the yarn twisting zone.

The behavior of the work surfaces, when an end is down, has been found to be a critical operational condition in the twist or friction false twist apparatus. In the event of the absence of a yarn between the work surfaces being pressed against each other, the work surfaces engage in a direct frictional contact, and are both heated up and rapidly worn out due to the high relative speed. In particular, in friction false twist assemblies having two crossing belts, the sensitive belt edges contact each other, and when they become worn, the threadline becomes unstable and the uniformity and quality of the produced crimped yarn is considerably impaired. In the case of belt assemblies of the prior art having means for pressing the friction surfaces against the yarn, even more pronounced wear of the belt edges occurs when an end is down, unless specific steps are provided to separate the belts in such an operational condition.

It is accordingly a specific object of the invention to provide a false twist apparatus of the described type wherein the running yarn exclusively contacts the medial portion of the belt surface and not the belt edges. Also, when an end is down, wear of the work surfaces due to their mutual contact is reduced and essentially eliminated.

According to one aspect of the invention, the above problem is solved by making the work surface spherical in a direction perpendicular to its running direction, so that wedge-shaped gaps are formed between it and the other cooperating work surface in the area of the marginal edges of the twisting zone. Such a curvature, which lifts the belt edges from the yarn and makes transfer of twist independent of the condition of the belt edges, may be obtained, for example, by using an endless belt with a convexly curved cross section of the yarn engaging friction surface or, in a further embodiment of the invention, by a corresponding spherical deformation of an endless flat belt. In this aspect of the invention, it has been found particularly advantageous that the wedge-shaped gap formed between the work surfaces tends to prevent the surfaces from touching each other, so that even after a long period of operation of the apparatus no wear occurs on the surfaces. Unexpectedly, it has been shown that the wedge-shaped gap provides a supporting effect by the accumulation of marginal layers of ambient air carried along on the work surfaces, which is sufficient to prevent wear of the work surfaces by friction for a yarn of 167 dtex and work speeds of more than 600 m/min. when the pressure applying member is not disconnected in the absence of a yarn.

It is also contemplated to discontinue the force applied by the pressure applying member against the back side of the flexible work surface by employing, for example, a yarn detector which acts through a signal to a control valve to stop the air supply. The pressure piston of the cylinder piston assembly may, for example, be pushed back to its initial position by spring force or another force transmitting means so that the pressure piston lifts from the back side of the adjacent friction surface.

It has been found that the present texturing apparatus can also be used in a particularly simple and advantageous manner to produce various types of effect (fancy) threads by, for example, varying the surface speed of the work surfaces according to a preset program. It is, however, preferred that the fluid pressure be varied periodically or according to a program, which allows the piston of the pressure applying member to similarly press against the inner face of the belt. It may be preferred to also apply these variations irregularly according to a random or non-periodic distribution. This allows the slip between the yarn and the friction surfaces to be advantageously effected, and permits control of the yarn thickness or the distribution of crimp degree in the yarn at the same operating speed, whereby certain textile technological effects can be brought about in a controlled manner.

It is also possible to purposely produce twisted areas in the yarn by periodically increasing the speed of rotation, while possibly simultaneously increasing the contact pressure, to thus intentionally obtain such textile technological effects. Finally, the work surfaces cooperating with the yarn may be designed with respect to their friction coefficient in such a manner that they provide an increased slip when the contact pressure is reduced periodically or in accordance with a predetermined program, and thus roughly act on the yarn surface in a manner which is intended to break filaments and impart a certain fiber yarn characteristic to textured multifilament yarns. To generate irregularities producing such effects, the yarn guides preceding and following the yarn treatment zone may be also adjusted in accordance with a preset program. It is also contemplated that the crossing angle and thus the twisting and advancing forces acting on the yarn may be varied, as well as varying the friction coefficients of the work surfaces.

Some of the objects and advantages of the invention having been stated, others will appear as the description proceeds, when taken in connection with the accompanying drawings, in which FIG. 1 is a top plan view of a yarn false twisting apparatus which embodies the present invention;

FIG. 2 is a side elevation view, partly sectioned, of the apparatus shown in FIG. 1;

FIGS. 3*a* and 3*b* are fragmentary sectional views of one embodiment of the pressure applying member used with the present invention, with the two views taken at 90° with respect to each other;

Figure 9:
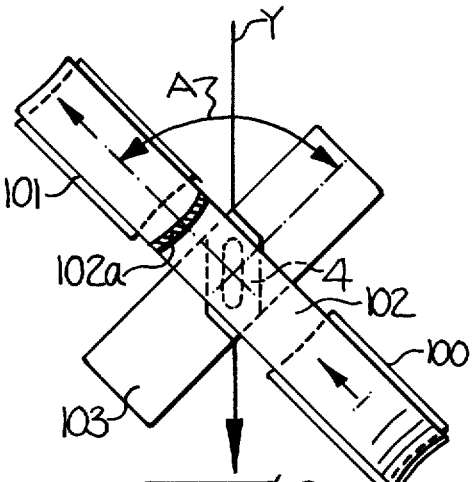
FIG. 9 is a top plan view of a further embodiment of the present invention.
Figure 10:
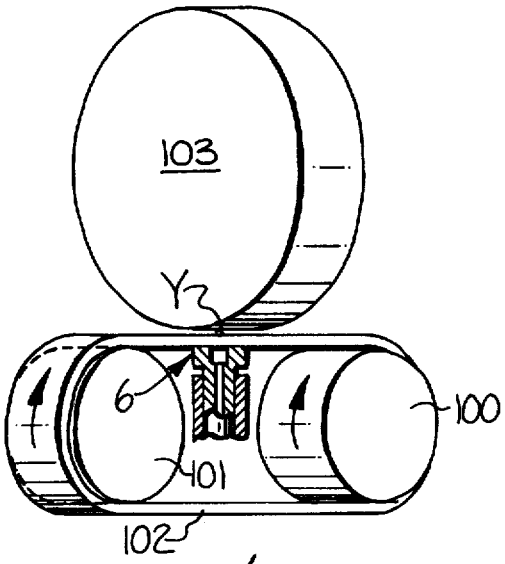
FIG. 10 is a side elevation view, partly sectioned, of the apparatus of FIG. 9.
Figure 10A:
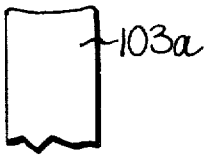
Figure 10B:
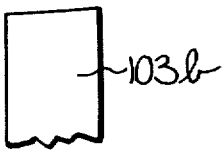
Figure 11:
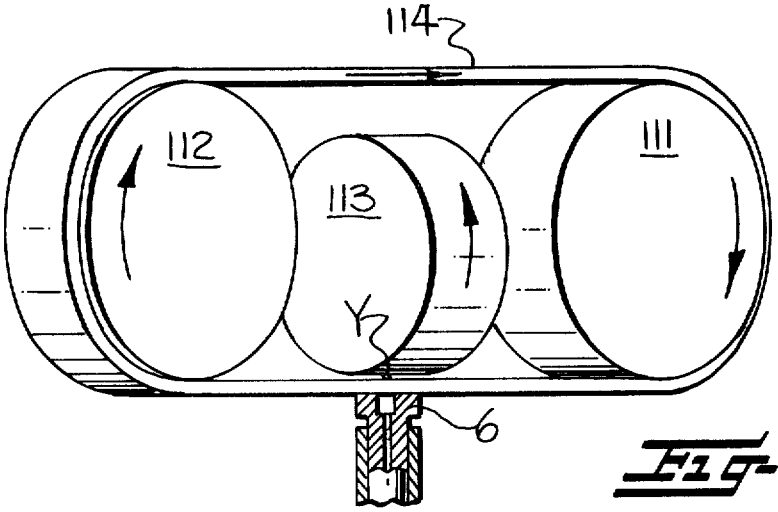
Figure 12:
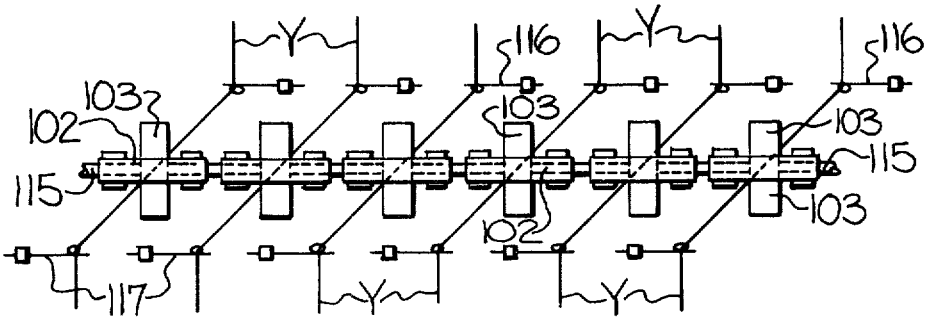
Figure 13:
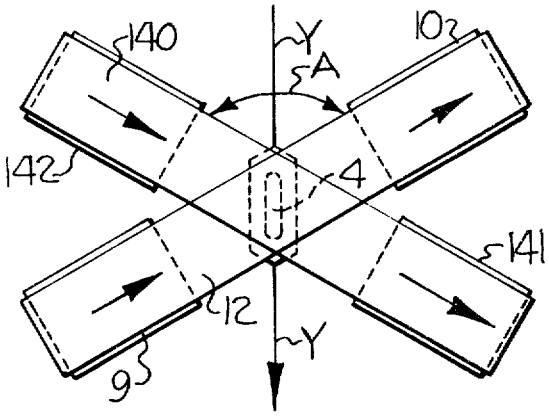
Figure 14:
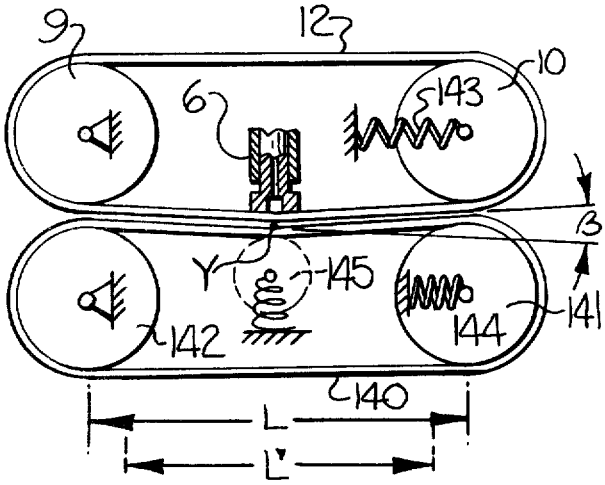
Figure 26:
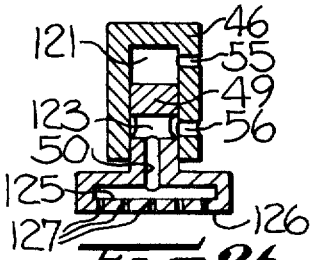
Figure 27:
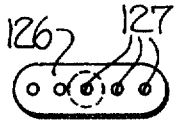
Figure 28:
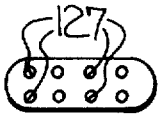
Figure 29:
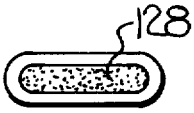
Figure 30:
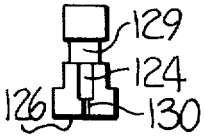
Figure 31:
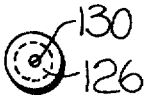
Figure 33:
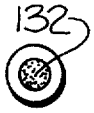
Figure 34:
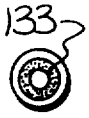
Figure 35:
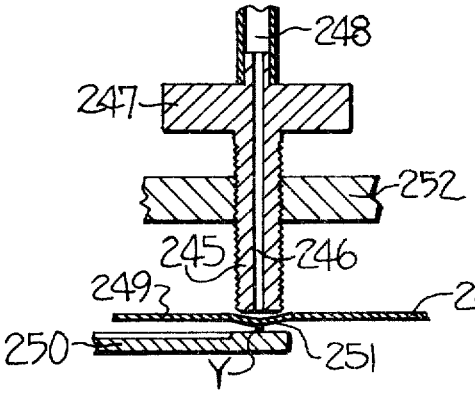

FIGS. 10*a* and 10*b* are fragmentary side elevation views illustrating alternative surface configurations for the back-up roll shown in FIG. 10;

FIG. 11 is a side elevation view, partly sectioned, of a further embodiment of the present invention;

FIG. 12 is a schematic representation of a false twisting machine having a plurality of yarn twisting stations, each employing the apparatus as illustrated in FIGS. 9 and 10;

FIG. 13 is a top plan view of an additional embodiment of the present invention;

FIG. 14 is a side elevation view, partly sectioned, of the apparatus shown in FIG. 13;

FIG. 15 is a top plan view of another embodiment of the present invention;

FIG. 16 is a side elevation view, partly sectioned, of the apparatus shown in FIG. 15;

FIGS. 17*a* through 17*f* are fragmentary sectional views illustrating the embodiments of the invention which include a curved friction surface;

FIG. 18 is a top plan view of another embodiment of the invention;

FIGS. 19–25 are sectional side elevation views of pressure applying members, or fragmentary portions thereof, in accordance with the present invention;

FIG. 26 is a sectional side elevation view of another embodiment of a pressure applying member in accordance with the present invention;

FIGS. 27–29 are bottom plan views illustrating various configurations of the pressure applying member of FIG. 26;

FIG. 30 is a sectional side elevation view of a piston for a pressure applying member;

FIGS. 31–34 are bottom plan views illustrating various configurations of the piston of FIG. 30; and FIG. 35 is a fragmentary perspective view of a further embodiment of the pressure applying member.

Figure 1:
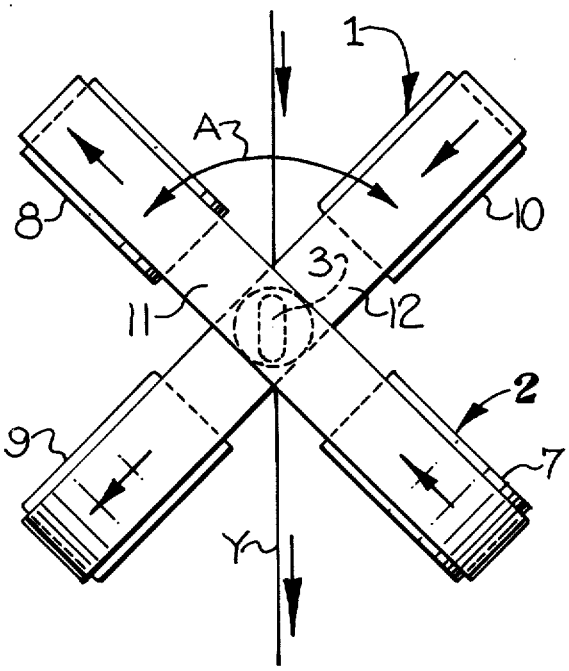

Referring more particularly to the drawings, FIG. 1 illustrates a yarn false twisting apparatus embodying the present invention and which comprises a pair of twist imparting members 1, 2. The member 1 is in the form of a relatively thin, flexible endless belt 12 having upper and lower runs, with each run having inner and outer flat faces, with the outer face of the lower run defining a yarn engaging friction surface. The belt 12 is mounted for rotation between a pair of mounting rollers 9, 10.

The member 2 comprises a second like belt 11, which is mounted for rotation between the mounting rollers 7, 8 and so as to be disposed at an adjustable angle A of about 90 degrees with the belt 12 in plan view. The outer face of the lower run of the belt 12 is disposed in an opposing, substantially non-contacting relationship with the outer face of the upper run of the belt 11, and defines a gap 13 and a twisting zone 3 therebetween as hereinafter further described. Suitable yarn guides (not shown) are provided for guiding the running yarn Y through the twisting zone 3 so as to both false twist and advance the yarn. It will also be noted that the endless belts 11 and 12 are more narrow than the surfaces of the mounting rollers 7–10.

The apparatus further includes a pressure applying member 5 disposed adjacent the inner face of the lower run of the belt 12 for locally biasing the belt toward the belt 11 only at the twisting zone 3 and during rotational movement of the two belts. A second like pressure applying member 5a is mounted adjacent the inner face of the upper run of the belt 11 and in a mirror image of the member 5. Thus a yarn Y may be continuously moved through the twisting zone 3 while having twist imparted thereto by frictional contact with the friction surfaces resulting from the force exerted by the two pressure applying members 5, 5a and while the friction surfaces remain in substantially non-contacting relationship with respect to each other.

Figure 3A:
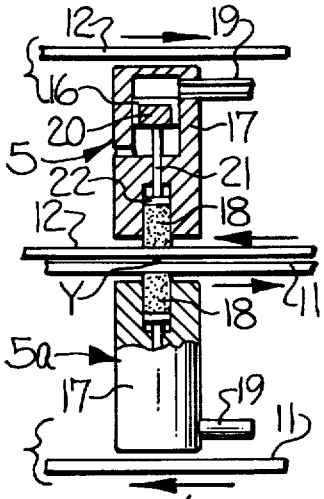
Figure 3B:
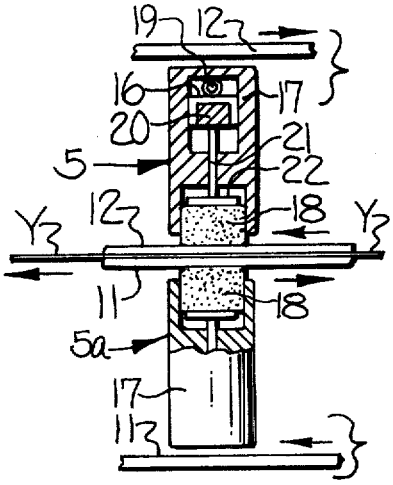

The pressure applying members 5, 5a are further illustrated in FIGS. 3a and 3b, and each comprises a cylinder 17 and a piston 16 slidably disposed in the cylinder for axial movement toward and away from the inner face of the associated belt. Pressurized air is delivered into the interior of the cylinder through the line 19 which serves to bias the piston downwardly. The piston includes a rod 21 mounting an insert 18 at the lower end thereof. The pressure force acting on the piston 16 is transmitted through an intermediate layer of resilient and vibration absorbing material 20 to piston rod 21, so that vibrations resulting from unevennesses of the face of the belt or the filament yarn itself are absorbed. Piston 16 is connected through piston rod 21 to a plunger 22, which is secured to insert 18, as by glue.

In accordance with the present invention, yarn twisting zone 3 can be geometrically defined by correspondingly profiling the cross section of insert 18. In this regard, the insert 18 includes a relatively long and narrow pressure surface facing the inner face of the associated belt, with the pressure surface being aligned with and sized to closely conform to the length and width of the path of the yarn through the twisting zone. Also, such a long and narrow or oval twisting zone is suitable to keep the wear between insert 18 and belt low, and to transfer at the same time a defined pressure force to the yarn. A sufficiently long guideway of piston rod 21 in the cylinder avoids having the insert body become tilted from wear.

The insert 18 may consist of graphite to keep friction low. A sintered graphite insert is preferred, which is interspersed with metallic particles of bronze, copper or the like to improve the dissipation of heat. On the other hand, the insert may consist of an open porous material which is impregnated with a suitable lubricant.

In a modified embodiment (not shown) the air or liquid lubricant may be supplied through an axial longitudinal bore in piston rod and plunger to the open porous sintered insert. For example, this lubricant may be a portion of the pressure fluid which acts on the piston of the pressure applying device. In addition, a finely dispersed liquid lubricant may be added to the stream of air.

Figure 4:
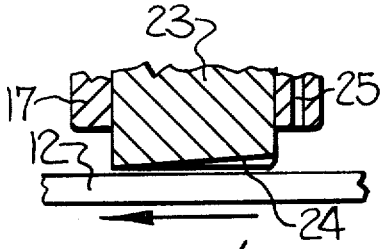
FIG. 4 is a fragmentary sectional view of a further embodiment of the pressure applying member.

FIG. 4 shows a pressure applying member which comprises a solid metallic insert 23 attached to a plunger 22 as described above. This insert 23 has parallel longitudinal edges for its guidance in the cylinder and an inclined or a wedge-shaped face 24 immediately adjacent the belt. The face 24 is inclined so as to have a decreasing depth in the direction of movement of the adjacent belt, to thereby form an air cushion therebetween. The insert 23 is made of a material highly resistant to wear. A lubricant, preferably water, a harmless finishing fluid for yarn or a suitable oil emulsion, may be applied in doses through nozzle 25 located in front of the insert in the direction of the running belt or, if necessary, provided in the insert itself, or through a wick, to the adjacent face of the belt. The lubricating film produced during operation of the apparatus between insert 23 and belt makes it possible to reduce the friction and the resulting heating of the insert, when the pressure forces are transferred to the belt.

Figure 2:
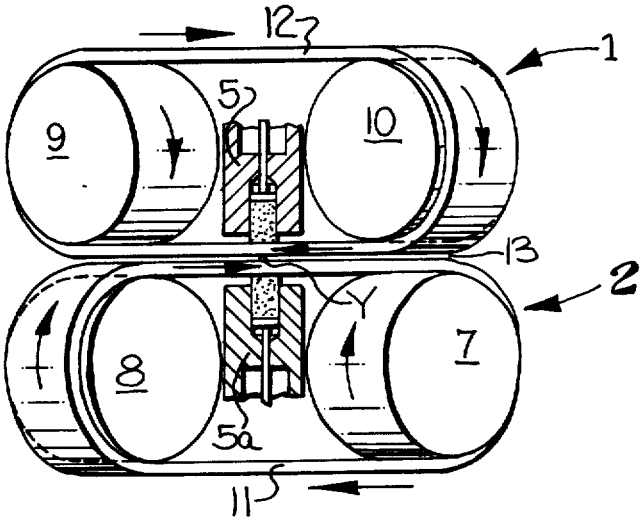
Figure 5:
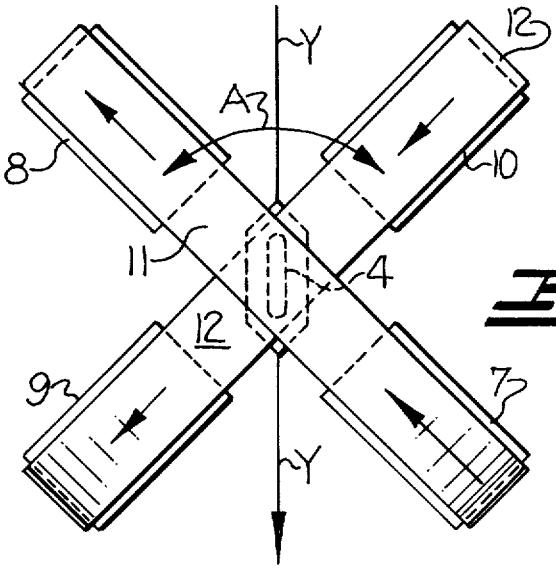
FIG. 5 is a top plan view of still another embodiment of a yarn false twisting apparatus embodying the present invention.
Figure 6:
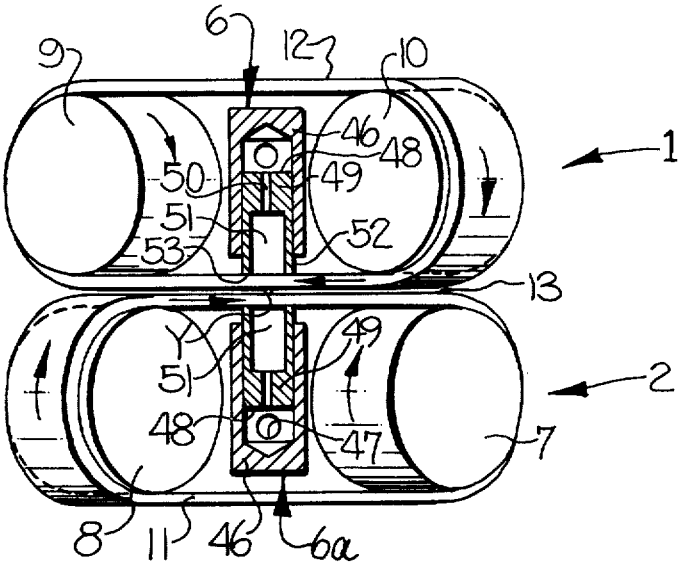
FIG. 6 is a side elevation view, partly sectioned, of the apparatus of FIG. 5.

FIGS. 5 and 6 show in top and side view a texturing apparatus similar to that of FIGS. 1 and 2, wherein each of the pressure applying members 6, 6a, includes a cylinder 46 having a piston 49 slideably mounted therein, and an air supply line 47. The piston includes an open skirt 52 at its lower free end, and an axial bore 50 through the piston head for admitting air into the area of the skirt. By this arrangement, pneumatic lubrication is provided between the lower edge 53 of the skirt and the face of the belt, as further described below. The skirt 52 is relatively long and narrow to define a pressure surface facing the inner face of the belt which closely conforms to the length and width of the yarn path of travel in the manner described above.

Figure 7:
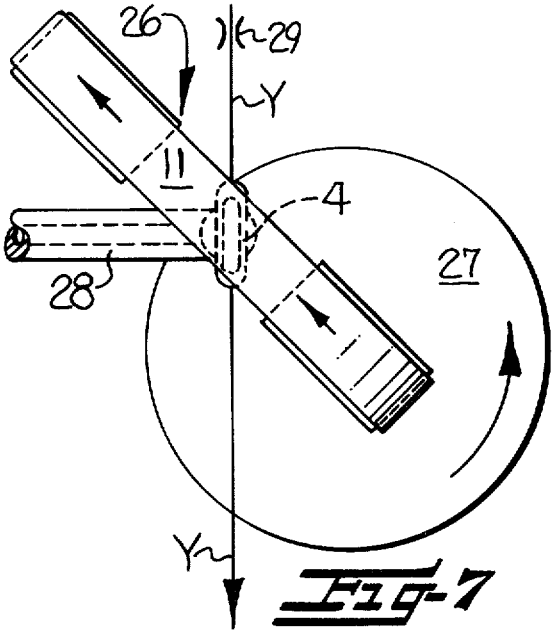
FIG. 7 is a top plan view of still another embodiment of the present invention.
Figure 8:
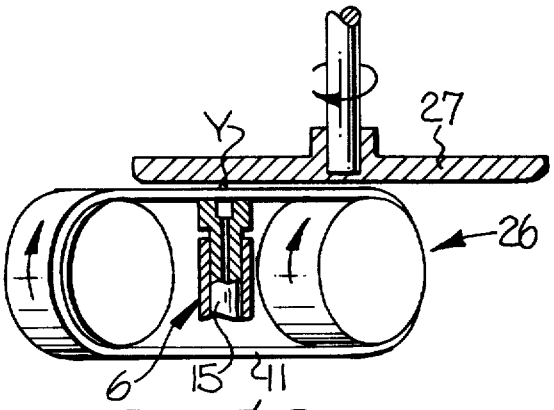
FIG. 8 is a side elevation view, partly sectioned, of the apparatus of FIG. 7.

FIGS. 7–8 of the drawings illustrate a further embodiment wherein the second twist imparting member comprises a rigid, substantially non-yielding circular disc 27 having an outer flat friction surface, and which is mounted for rotation about an axis disposed perpendicular to the runs of the belt 11. The belt 11 is mounted so that its upper run is parallel to the surface of the disc to define a twisting zone 4 therebetween, and a yarn guide 29 is provided for conveying the yarn Y along a direction parallel to the plane of the disc 27. A pressure applying member 6 as described above is mounted immediately below the upper run of the belt by the support 28, to locally bias the belt only at the twisting zone, and during rotation of the two members in the direction indicated by the arrows.

FIG. 9 shows in top plan view and FIG. 10 in side elevation view a texturing apparatus which includes a belt 102 running between two mounting rollers 100 and 101, and tangentially along the circumferential rigid surface of back-up roller 103, which is in the form of a right circular cylinder. The friction surfaces of the belt 102 and back-up roller 103 jointly act on the yarn Y and cross each other at an adjustable angle A in plan view. Belt 102 is preferably an endless flat belt of a suitable synthetic rubber or plastic material, and is tensioned between the two mounting rollers and driven by one of these two rollers. Back-up roller 103 may be driven in any desired way, such as by a belt drive, a direct electrical drive, or a friction drive.

As best seen in FIG. 10, the belt 102 is locally pressed by means of a fluid-dynamically operating pressure applying member 6, which acts on the inside face of the belt locally at the twisting zone 4 so as to bias the yarn against the rotatably driven surface of the back-up roller 103. In a preferred embodiment, the pressure applying member is a cylinder-piston assembly, whose piston is operated by compressed air, in the manner described above. FIG. 10a shows an alternative design of the back-up roller 103a, which has a peripheral surface in the form of a hyperboloid. In such an embodiment, the crossing belt 102, as indicated in FIG. 9 in section 102a, is locally deformed by a convexly curved piston surface of pressure applying member 6. FIG. 10b illustrates a further possible design of the back-up roller 103b, wherein the peripheral surface is in the form of a truncated cone.

FIG. 11 illustrates a further embodiment wherein the texturing apparatus includes a belt 114 and a rigid back-up roller 113. Mounting rollers 111 and 112 have such a large diameter that cylindrical roller 113 can be accommodated in the space enclosed by the two belt mounting rollers and the belt 114, and the pressure applying member 6 is located outside of the belt 114 and presses it locally against yarn Y and the circumferential surface of rigid roller 113.

FIG. 12 is a schematic illustration of a yarn false twist machine having a plurality of false twisting stations positioned in side by side relation along the length of the frame. Each false twist station includes a texturing apparatus as shown in FIGS. 9 and 10. To simplify the drives, all rollers 103 are coaxially arranged to each other on a common horizontal drive shaft 115 so as to be driven synchronously. The individual belts 102 are arranged at a distance corresponding to the narrowest machine gauge, next to each other and opposite the rollers 103. Individual biasing means (not shown) press against the belts 102 and thus against the yarns Y supplied by yarn guides 116 and 117 on the bisecting line of crossing angle A between the work surfaces. To change the crossing angle between the twist imparting work surfaces, belts 102 are mounted so that they can be individually pivoted in relation to roller 103. Also rear yarn guide 116 can be shifted parallel to drive shaft 115 of rollers 103 so that the yarn is again conducted along the intended yarn nip line between the work surfaces and essentially on the bisecting line of crossing angle A.

FIGS. 13 and 14 show a texturing apparatus similar to that in FIGS. 5 and 6, and with the numerals of the upper belt assembly and pressure applying member corresponding with those in FIGS. 5 and 6. The lower belt 140 is mounted between the mounting rollers 141 and 142 and crosses belt 12. According to this present aspect of the invention, the bottom belt 140, however, has no pressure applying member in direct contact therewith. To obtain an adequate nipping effect on the yarn, and yet to be able to operate without undue air consumption, the following conditions are preferred. Initially, the belt 140 is preferably more tensioned than the belt 12. This is preferably achieved with the use of force transmitting means, such as tension springs 143 and 144, which have different characteristics, with the spring 144 providing the belt 140 with more tension, preferably approximately 50% more. In addition, it is proposed to keep the center to center distance between the two mounting rollers 141 and 142 as small as is technically feasible, so as to obtain a higher rigidity in belt 140, and a lesser deflection by pressure applying member 6 acting on belt 12, as well as a greater elastic force of reaction (spring-back resilience) opposed to the biasing pressure force which is exerted by the piston for the purpose of nipping the yarn. As illustrated schematically in FIG. 14, the center to center distance L' between the axes of the mounting rollers 141, 142 may be less than the distance L between the axes of the rollers 9, 10. Typically, the distance L' is less than about 1.4 times the diameter of the rollers 141, 142, and the distance L between the axes of the rollers 9, 10 is between about 1.7 to 2.0 times the diameter of the rollers.

The rigidity of belt 140, which makes it unnecessary to have an associated pressure applying member, may be amplified by the use of a freely pivotally mounted supporting roller 145, which is shown in FIG. 14 in dotted lines, and whose rotary shaft is arranged perpendicularly to the direction in which the contact pressure force acts on the yarn. This supporting roller 145 is driven by the belt 140, and may be also pressed by suitable force transmitting means against the belt as shown schematically in FIG. 14. The peripheral surface of the supporting back-yp roller 145 may be substantially hyperbolic in cross section in a manner comparable to the roller 103*a* (FIG. 10*a*), and the pressure applying member 6 having a convex pressure surface which generally conforms to the hyperbolic surface.

Referring more specifically to the apparatus shown in FIGS. 13 and 14, it has been found that the tension in the less tightened belt 12 should be carefully controlled so as to obtain a stable threadline. It has been found that one criterium to determine the tensile forces in belts 12 and 140 consists in the specification of a parameter which is independent of other variable parameters, such as denier, friction coefficient, crossing angle A, twist level in the yarn etc., i.e., the range of the funicular polygon angle B for the deflection of the belts, and in which the apparatus provides textile technologically good values at an economically practical setting. In a crossing belt assembly according to the invention, this funicular polygon angle B on the belt should range between 1 degree and 6 degrees, preferably between 2 degrees and 4 degrees. This results in an adequately stable threadline. At an average pressure force of the belt against the yarn and with approximately 2 to 2.5 N (Newton) pressure being applied, the tension in the tightened belt 140 is calculated, using simple known equations, and the tension of the less tightened belt 12 amounts to approximately 60 to 75% of the value calculated for belt 140. With these values, springs 143 and 144 can be correspondingly dimensioned.

The friction false twist apparatus schematically shown in FIGS. 15 and 16 consists essentially of mounting rollers 200 and 201 for the first belt 202 and mounting rollers 203 and 204 for the second belt 205. Both belts, preferably endless belts, are arranged in such a manner that they enclose crossing angle A which is symmetrically adjustable to the threadline, and are driven, with regard to the yarn Y nipped between the friction surfaces of the endless belts, essentially in opposite directions (note the direction of arrows in FIG. 16). It should be noted that, according to FIG. 15, the endless belts 202 and 205 are wider than the mounting rollers so that the longitudinal edges of the belts project on both sides of the mounting rollers. Due to their initial tension, the flexible flat belts are thus deflected over the edges of the mounting rollers, with the friction surfaces being convexly deformed toward the yarn. Initial tension to the belts is provided by force transmitting means, such as tension springs 143 and 144 according to FIG. 16, of which spring 144 has a greater resilience than spring 143, so as to provide endless belt 205 with a higher initial tension and thus to give it greater resistance to sagging. The other endless belt 202 is locally pressed by a pressure applying member 206 on its inside face in the area of the twisting zone, whereby yarn Y is nipped between the friction surfaces and receives the desired twist. The twisting zone is defined by the shape of surface 210 of pressure apparatus 206 and, for example, is oval as shown in FIG. 15, or circular as shown in FIG. 18. To assist a convex deformation of endless belt 202 toward the threadline in the twisting zone, the twisting zone (as seen in flow direction of the yarn) is shorter than the overlap of endless belts 202 and 205 as seen in top plan view, i.e., the diagonal of the rhombus formed by the endless belts in top plan view and which extends parallel to the yarn, and preferably also shorter than the respective width of the crossing endless belts.

Pressure applying member 206, which preferably is a cylinder-piston assembly and actuated by a pressure fluid, will be more specifically described below. At this point, it should be noted that in the pressure applying member 206 according to FIG. 16, the piston or pressure shoe 211 is moved against a defined restoring force, such as pressure spring 212. Pressure spring 212 rests against cylinder 213, and when the air pressure is released or cylinder 213 is ventilated, the piston is moved back to its initial withdrawn position so that pressure shoe 211 is separated from the back side of belt 202.

FIGS. 15 and 16 also schematically illustrate a yarn sensor 214 for sensing the yarn moving through the apparatus. As soon as the sensor detects the absence of yarn, a signal is sent to activate a self-ventilating control valve 215, resulting in the pressure applying member 206 being disconnected from the source of pressure fluid 216. Also, the member 206 is ventilated through control valve 215 so that piston or pressure shoe 211 is withdrawn from endless belt 202 by the tensioned pressure spring 212. FIG. 16 also schematically illustrates means at 217 for varying the force exerted by the pressure fluid upon the piston 211 of the pressure applying member 206, in accordance with a non-periodic pattern or the like.

FIGS. 17*a* through 17*f* show in cross section various embodiments of the belts of the false twist apparatus. FIG. 17*a* shows such a false twist apparatus with crossing belts comprising endless belts 218 and 219, which have a unilaterally curved cross section toward the yarn path. In such an assembly, the belt mounting rollers (not shown) are cylindrical or have a barrel-shaped running surface in cross sectional view to stabilize the endless belt against a lateral displacement on the mounting rollers. However, to stabilize the belt path, it is also possible to provide the mounting rollers with a butting collar, or to use laterally arranged guide rollers with their rotary shaft in an essentially perpendicular plane to the belt path. In the preferred embodiment according to FIG. 17*a*, at least one of the endless belts is also pressed by a pressure applying member 206 in the manner described above.

It should be noted again that the advantages according to the invention are achieved if one or preferably both endless belts are convexly curved perpendicularly to their running direction and form a wedge-shaped gap in the area of the yarn nipping line. In such case, the carrying effect of the accumulating marginal air layer at high operating speeds permits the friction surfaces of the endless belts to move across each other without friction when a yarn is absent, and the disconnecting means for the pressure apparatus 206, as illustrated in the drawing, is not absolutely needed. However, it is preferred to use such disconnecting means to reduce air consumption when an end is down.

FIG. 17*b* shows a false twist apparatus with friction surfaces formed by two endless belts 220 and 221, according to FIGS. 15 and 16. One of these belts is pressed from the back side thereof against the yarn by pressure piston 222 having curved edges. By this arrangement, the work surface resting against the piston surface, and being formed by flat belt 220 conducted over the mounting rollers, is convexly deformed in the area of the threadline, and the belt edges are lifted off the threadline, and the friction surfaces have a free gap between them, before pressure applying member 222 is connected. It should also be noted that endless belt 221 may be substituted by a friction surface formed by a rigid disk or back-up roller within the framework of this aspect of the invention.

FIG. 17*c* shows a simplified cross section of a false twist assembly according to FIG. 18, in which one of the mounting rollers 223 and 225 for each of the endless belts 227 and 228 has a barrel-shaped running surface, whereas the other mounting rollers 224 and 226 are formed by a cylindrical roll, whose width is greater than the width of the flat belts. This provides that both flat belts 227 and 228 arch in the area of the threadline, with the friction surface being convexly curved toward the threadline. This convexity is increased by pressure pistons 229 of the pressure applying member, which has a circular cylindrical cross section and which acts upon the back side of the flat belts and presses their friction surfaces against the yarn path. As is shown in FIGS. 17*c* and 18, the pressure zone is considerably more narrow than the width of the belts to enhance the convex deformation of the endless belts. Naturally, both mounting rollers 223, 226 or respectively 224, 225 could be barrel-shaped.

FIG. 17*d* shows an embodiment wherein the pressure applying member has a pressure shoe 230, which can be shifted in the cylinder of a cylinder-piston assembly, or moved by another force transmitting means. The face of this pressure shoe holds a freely rotatable pressure roll 231 with a barrel-shaped running surface, which shoe convexly curves endless belt 232 against the yarn in the twisting zone. It should be noted again that a rigid disc or back-up roller as described above may be substituted for the endless flat belt 233. Also, the pressure roll may take the form of a cylindrical roll having a length less than the width of the belt (note FIG. 17*e* at 231*e*), or of a roll having a cylindrical central portion and tapered end portions (note FIG. 17*f* at 231*f*). As in the foregoing examples, the mounting rollers for the belts may also have a longitudinal section in the shape of a barrel or cylinder, with conical or barrel-shaped end areas.

Similarly to the pressure apparatus described and illustrated in FIGS. 3 and 4, the pressure applying member 6, as shown in FIGS. 6, 8, 10, 11, and 14, consists of a cylinder-piston assembly which may be actuated by a pressure fluid. The pressure fluid is supplied to cylinder 46 through supply line 47, and acts statically on the inside surface 48 of piston 49. The piston includes an axial bore 50 which communicates with a chamber or cavity 51 at the lower free end of the piston and which is defined by a surrounding skirt 52 having a lower rim 53. The air flows through axial bore 50 in piston 49 into the cavity 51, and forms an open air cushion. In its cross section, the skirt 52 is shaped according to the desired geometrical form of pressure zone 4, 210 or 229 respectively.

The piston moves outwardly toward the belt when pressure is applied to it, and until it touches the adjacent face of the belt. Due to the sealing effect of the skirt of the piston, a further outflow of the air is essentially precluded. Assuming that the gap between the piston surface and the face of the belt is sealed, the pressures in front of the piston surface and in the air cushion chamber balance, with a balance of forces being established. However, since leakage occurs between the skirt of the piston and the rotating belt, air always flows through the axial bore, and the pressure in the air cushion chamber is thus less than that on the surface of the piston. Thus, the skirt of the piston is pressed somewhat more and the sealing effect is increased, which again leads to reduced leakage. The position of piston, gap width, consumption of air and the action of the force by the piston on the belt thus interdepend, with a state of equilibrium being established automatically. The fluid pressure built up in the air cushion chamber can only be relieved through a gap, which forms between the lower rim of the skirt of the piston and the face of the belt, with the gap precluding frictional contact between the two surfaces and the pressure force being thus transmitted through an interposing air cushion. Thus, the preferred embodiment of the pressure applying member according to the invention is based on this mechanism of pneumatic lubrication of the piston surface, with simultaneous exertion of an adjustable pressure force on a flexible work surface in the twisting zone.

The lower rim 53 of the skirt 52 of the piston is suitably shaped, as shown in FIGS. 22 to 25, to take into account the conditions of the texturing apparatus, the surface properties of the belt, the desired surface pressure in the twisting zone, or the consumption of the air. Thus, for example, the wide rim between the air cushion chamber 51 and the outer atmosphere as indicated at 53 in FIG. 22, or a series of ridges forming the labyrinth-like structure in the piston rim surface as illustated at 53*c* and 53*d* in FIGS. 24 and 25, serve to reduce the consumption of compressed air, while a narrow rim surface as shown at 53*b* in FIG. 23 effects a sharper definition of the twisting zone 4.

Figure 21:
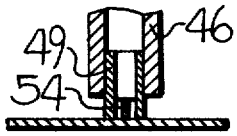
Figure 22:
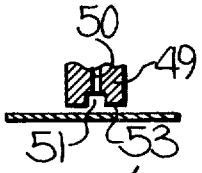
Figure 23:
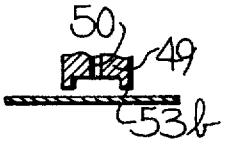
Figure 24:
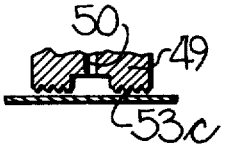
Figure 25:
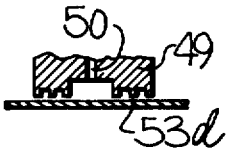

A piston having an air cushion chamber in its surface is preferred so as to completely avoid friction between the piston and the face of the belt according to the present invention. However, as shown in FIG. 21, the piston can be also constructed in such a manner that is has several axial bores or slots 54 in the axial direction, through which a stream of the pressure fluid can continuously flow out, which "lubricates" the pressure surface of the piston. Such slots, for example, are suitable for oblong or elongated oval piston surfaces.

Figure 19:
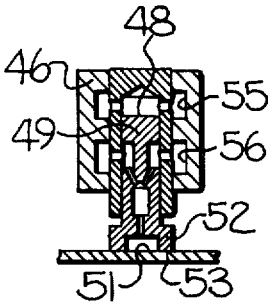
Figure 20:
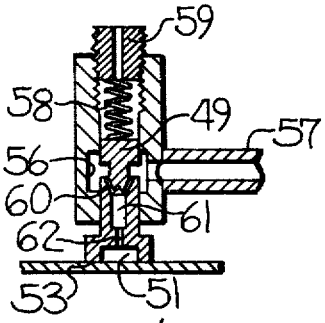

In FIGS. 19 and 20, the above described pressure applying member is modified in such a manner that the cylinder-piston assembly is connected to two different sources of pressure through annular ducts 55 and 56, with the duct 55 communicating with a chamber above the upper face 48 of the piston 49, and the annular duct 56 communicating with the air cushion chamber 51 formed by the skirt 52. This presents the advantage that the pressure force on the face 48 of the piston is independent of the quantitative supply to the air cushion chamber 51, since it can be separately adjusted through a self-contained compressed air supply. This permits the pneumatic lubrication film (air cushion) between piston surface and the back face of the disc to be separately adjusted.

As shown in FIG. 20, the cylinder-piston assembly is additionally modified by the action of a force produced by the pressure fluid on the face 48 of piston 49, together with a pressure spring 58, which is biased against the face 48. Other suitable biasing means could be employed for this purpose, such as a permanent magnet, an electromagnet, a weight or the like. The spring 58 may if desired be mechanically preloaded by an adjustable screw cap 59, which also includes a bore for venting air from the chamber above the piston face. Compressed air for the air cushion in the cavity 51 is supplied from a line 57 to the annular duct 56, and then through the passages 60, 61, and 62.

FIGS. 26–34 schematically illustrate further embodiments of the cylinder-piston structure for the pneumatically operating pressure member. As here illustrated the pressure applying member consists of a cylinder 46, which can be connected through two fluid supply ducts 55 and 56 and to two sources of pressure (not shown). It should be noted that the fluid pressures in both lines can be constantly adjusted through usual valves or throttling devices to a predetermined value, at which the pressure applying member provides the best texturing results for a multifilament yarn processed and for certain machine settings. These values can be easily determined by simple tests.

Fluid supply duct 55 terminates in the cylinder 46 in a pressure space 121 above the piston 49 and pushes the piston out of cylinder 46 until it has reached an extended position defined by a stop (not shown) or until a counterforce has restored the equilibrium of forces. The second fluid supply duct 56 terminates in pressure space 123 in the piston 49 and is connected through an axial bore 50 to distributor duct 125 and to piston surface 126. The pressurized air emerging from the surface 126 of piston, forms a pressure cushion between piston surface 126 and the back face of the flexible belt. Through this cushion, the force supplied by the piston is transmitted to the yarn twisting zone, and friction and wear are substantially eliminated. The longitudinal section in FIG. 26 and the bottom view of piston surface 126 in FIG. 27, show that the pressure fluid serving for the air lubrication is distributed from the distributor duct 125 which extends locally along the yarn nip line through several holes 127 provided in the piston surface 126. According to FIG. 28, the pressurized air is distributed to two parallel arranged lines of holes 127, whereas in FIG. 29 a zone 128 of the piston surface extends along the yarn nip line, and consists of a porous material which is inserted in the piston surface, and which, if needed, may be arcuately curved along one dimension.

Figure 32:
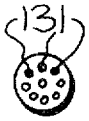

Pressure applying members using a piston 129 as shown in FIG. 30 have proven to be successful. Axial bore 124, through which the pressure fluid needed for the air lubrication emerges, terminates in a central narrowed or throttle bore 130 in the piston surface 126 of piston 129, or in an annular duct, which may be followed, for example, by holes 131 distributed around the circumference as shown in FIG. 32, a porous circular surface 132 as shown in FIG. 33, or a porous annular surface 133 in the piston surface as shown in FIG. 34. In addition to the pressure applying member providing an air cushion on the piston surface, the construction of the piston surface 126 as described and shown in FIGS. 26–34 makes it possible to also suppress high frequency oscillations occurring at difficult operational settings and high speeds of the work surfaces, which can adversely affect the smooth run of yarn and generate disturbing noise.

FIG. 35 shows a further embodiment of the invention wherein the biasing means comprises an elongate tubular member 245, which includes an axial bore 246 and a knob 247 at one end. An air supply tube 248 delivers pressurized air to the duct 246, so that the air exhausts from the lower end and presses against the adjacent face of the endless belt 249, and forms an air cushion therebetween. Also, the belt is elastically deformed toward the rotating rigid disc 250 in the illustrated (somewhat exaggerated) manner at 251, by the force of the air. The member 245 is externally threaded, and is threadedly supported in the mounting frame member 252 of the false twisting apparatus. Thus rotation of the knob 247 acts to vary the gap between the lower free end of the member 245 and the belt 249.

In the drawings and specification, there has been set forth a preferred embodiment of the invention, and although specific terms are employed, they are used in a generic and descriptive sense only and not for purposes of limitation.

That which is claimed is:

1. A yarn false twisting apparatus comprising a pair of twist imparting members, at least one of said members comprising a flexible endless belt having inner and outer faces, with one of said faces defining a yarn engaging friction surface, and with the other of said twist imparting members also including a yarn engaging friction surface, means mounting said members for rotational movement wherein portions of the respective yarn engaging friction surfaces are disposed in opposing, substantially non-contacting relationship and define therebetween a twisting zone for accommodating a running yarn, means for rotating each of said members such that their respective yarn engaging friction surfaces run in different directions through said twisting zone, and means operatively mounted adjacent the other face of said belt for locally biasing said belt toward the other member only at said twisting zone and such that the biasing force is substantially limited to an area which is coincident to the path of the running yarn, and without generating substantial friction between said biasing means and belt, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

2. The yarn false twisting apparatus as defined in claim 1 wherein said biasing means includes a relatively long and narrow pressure surface disposed adjacent said other face of said belt and which is aligned with the path of the yarn through said twisting zone.

3. The yarn false twisting apparatus as defined in either claim 1 or 2 wherein said other twist imparting member comprises a second endless belt which is mounted at an adjustable angle with respect to said first mentioned belt, and said apparatus further comprises a second like biasing means mounted adjacent said second belt in a mirror image of said first mentioned biasing means.

4. The yarn false twisting apparatus as defined in either claim 1 or 2 wherein said other twist imparting member comprises a rotatably mounted back-up roller having a relatively rigid peripheral surface defining said yarn engaging friction surface thereof.

5. The yarn false twisting apparatus as defined in claim 4 wherein said means for mounting said back-up roller includes means for angularly adjusting the axis of rotation thereof, whereby the angle between the yarn path of travel and a plane which is perpendicular with respect to said axis of rotation may be adjusted.

6. The yarn false twisting apparatus as defined in claim 4 wherein said back-up roller is cylindrical.

7. The yarn false twisting apparatus as defined in claim 4 wherein said back-up roller is a truncated cone.

8. The yarn false twisting apparatus as defined in claim 4 wherein said back-up roller has a substantially hyperbolic peripheral surface in cross section, and said biasing means includes a pressure applying member having a convex pressure surface which generally conforms to said hyperbolic surface.

9. The yarn false twisting apparatus as defined in claim 4 wherein said back-up roller is mounted within the area encompassed by said belt, and said biasing means is positioned adjacent the outer face of said belt.

10. The yarn false twisting apparatus as defined in either claim 1 or 2 wherein said other twist imparting member comprises a rigid, substantially non-yielding circular disc mounted for rotation about an axis disposed perpendicular to the runs of said endless belt.

11. The yarn false twisting apparatus as defined in either claim 1 or 2 wherein at least one of said yarn engaging friction surfaces is arcuately curved in cross section when viewed in a direction perpendicular to its direction of movement.

12. The yarn false twisting apparatus as defined in claim 11 wherein said endless belt is readily flexible, and said endless belt is deformed into said arcuately curved cross sectional configuration.

13. The yarn false twisting apparatus as defined in claim 12 wherein said mounting means for said endless belt comprises a pair of mounting rollers, with at least one of said mounting rollers having a barrel-like configuration to deform said endless belt into said arcuately curved cross sectional configuration.

14. The yarn false twisting apparatus as defined in claim 12 wherein said mounting means for said endless belt comprises a pair of mounting rollers, with at least one of said mounting rollers having a width less that that of said endless belt to deform said endless belt into said arcuately curved cross sectional sectional configuration.

15. The yarn false twisting apparatus as defined in claim 12 wherein said biasing means includes a pressure applying member positioned to act upon the other face of said endless belt at said twisting zone, said pressure applying member having a widthwise extent substantially less than the width of the belt to deform said endless belt into said arcuately curved cross sectional configuration.

16. The yarn false twisting apparatus as defined in claim 12 wherein said biasing means includes a pressure applying member positioned to act upon the other face of said endless belt at said twisting zone, said pressure applying member having an arcuately curved pressure surface which conforms to the arcuately curved configuration of said belt.

17. The yarn false twisting apparatus as defined in claim 16 wherein said pressure applying member includes a rotatably mounted roll having a barrel-like configuration and which defines said arcuately curved pressure surface.

18. The yarn false twisting apparatus as defined in claim 16 wherein said pressure applying member includes a rotatably mounted cylindrical roll having a length less than the width of said belt.

19. The yarn false twisting apparatus as defined in claim 16 wherein said pressure applying member includes a rotatably mounted roll having a cylindrical central portion and tapered end portions.

20. The yarn false twisting apparatus as defined in either claim 1 or 2 wherein said other twist imparting member comprises a second endless belt which is mounted at an adjustable angle with respect to said first mentioned belt, and said mounting means comprises a pair of mounting rollers for each of said belts, and means for resiliently separating the mounting rollers of each pair to tension the belt thereon.

21. The yarn false twisting apparatus as defined in either claim 1 or 2 further comprising means for sensing the yarn moving through the twisting zone, and means responsive to the sensing means for terminating operation of said biasing means upon the absence of a yarn moving through the twisting zone.

22. The yarn false twisting apparatus as defined in either claim 1 or 2 wherein said biasing means further comprises means for varying the force exerted thereby in accordance with a non-periodic pattern.

23. A yarn false twist machine having a frame, a plurality of false twisting stations positioned in side-by-side relation along the length of said frame, and means for feeding a yarn through each of the false twisting stations, the improvement wherein said false twisting stations include a shaft rotatably mounted to said frame and extending horizontally therealong, a roller fixedly mounted to said shaft in association with each of said stations, an endless belt rotatably mounted adjacent each roller such that the outer face of the belt is disposed in opposing, substantially non-contacting relationship with the peripheral surface of its associated roller to define opposed friction surfaces and a twisting zone therebetween, means for rotating said shaft and each of said belts such that the opposing surfaces run in different directions through said twisting zone, means for guiding a running yarn through each of said twisting zones, means operatively mounted adjacent the inner face of each belt for locally biasing such belt toward the peripheral surface of the associated roller only at said twisting zone, whereby each yarn may be continuously moved through a twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

24. The yarn false twisting apparatus as defined in claim 1 wherein said biasing means acts to deflect said belt toward the other member at said twisting zone.

25. A yarn false twisting apparatus comprising first and second twist imparting flexible endless belts, with each belt having inner and outer faces, and with said outer faces of each belt defining a yarn engaging friction surface, means mounting said belts at a predetermined angle with respect to each other and for rotational movement wherein portions of the respective yarn engaging friction surfaces are disposed in opposing, substantially non-contacting relationship and define therebetween a twisting zone for accommodating a running yarn, said mounting means comprising a pair of mounting rollers for each of said belts, and means for resiliently separating the mounting rollers of each pair to tension the belt thereon, and with said separating means for said first belt providing a greater force than the separating means for said second belt, means for rotating each of said belts such that their respective yarn engaging friction surfaces run in different directions through said twisting zone, and means operatively mounted adjacent said inner face of said second belt for locally biasing said second belt toward the first belt only at said twisting zone and without generating substantial friction between said biasing means and said second belt, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

26. The yarn false twisting apparatus as defined in claim 25 wherein the force of said separating means for said one pair of rollers is about 1.5 times the force of said separating means for said other pair of rollers.

27. The yarn false twisting apparatus as defined in claim 25 wherein the distance between the axes of said mounting rollers for said first belt is less than the distance between the axes of said mounting rollers for said second belt.

28. The yarn false twisting apparatus as defined in claim 25 further comprising a back-up roller positioned to engage the inner face of said first belt and in alignment with said biasing means.

29. The yarn false twisting apparatus as defined in claim 28 wherein the peripheral surface of said back-up roller is substantially hyperbolic in cross section, and said biasing means includes a pressure applying member having a convex pressure surface which generally conforms to said hyperbolic surface.

30. A yarn false twisting apparatus comprising a pair of twist imparting members, at least one of said members comprising a flexible endless belt having inner and outer faces, with one of said faces defining a yarn engaging friction surface, and with the other of said twist imparting members also including a yarn engaging friction surface, means mounting said members for rotational movement wherein portions of the respective yarn engaging friction surfaces are disposed in opposing, substantially non-contacting relationship and define therebetween a twisting zone for accommodating a running yarn, means for rotating each of said members such that their respective yarn engaging friction surfaces run in different directions through said twisting zone, and means operatively mounted adjacent the face of said belt opposite its yarn engaging friction surface for locally biasing said belt toward the other member only at said twisting zone and without generating substantial friction between said biasing means and belt, said biasing means comprising a piston mounted for axial movement toward and away from the adjacent face of said belt and including a pressure surface directly opposing the adjacent face and aligned with said twisting zone, and resilient means for urging said piston and pressure surface toward the adjacent face of said belt, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

31. The yarn false twisting apparatus as defined in claim 30 wherein said piston includes an insert, the lower end of which defines said pressure surface, and with said insert formed of a material having a low coefficient of friction.

32. The yarn false twisting apparatus as defined in claim 31 wherein said insert comprises graphite.

33. The yarn false twisting apparatus as defined in claim 31 wherein said insert comprises an open porous material, and a lubricant impregnated within said open porous material.

34. The yarn false twisting apparatus as defined in claim 31 wherein said biasing means further comprises passageway means for conveying a fluid directly to the surface of said other face of said belt, and so that the fluid acts as a lubricant between said insert and said other face.

35. The yarn false twisting apparatus as defined in claim 31 wherein the pressure surface of said insert is inclined with respect to said other face and so as to have a decreasing depth in the direction of movement of the adjacent belt to thereby form an air cushion therebetween.

36. The yarn false twisting apparatus as defined in any one of claims 30–35 wherein said piston is slideably mounted in a receptacle, and wherein said resilient means for urging said piston and pressure surface toward said other face of said belt comprises pneumatic means operatively connected to said receptacle.

37. A yarn false twisting apparatus comprising a pair of twist imparting members, at least one of said members comprising a flexible endless belt having inner and outer faces, with one of said faces defining a yarn engaging friction surface, and with the other of said twist imparting members also including a yarn engaging friction surface, means mounting said members for rotational movement wherein portions of the respective yarn engaging friction surfaces are disposed in opposing, substantially non-contacting relationship and define therebetween a twisting zone for accommodating a running yarn, means for rotating each of said members such that their respective yarn engaging friction surfaces run in different directions through said twisting zone, and means operatively mounted adjacent the face of said belt opposite its yarn engaging friction surface for locally biasing said belt toward the other member only at said twisting zone and without generating substantial friction between said biasing means and belt, said biasing means comprising a piston having a free end positioned to directly overlie the adjacent face of said belt and in alignment with said twisting zone, and means for conveying pressurized air between said free end of said piston and said other face and so as to form an air cushion therebetween, whereby a yarn may be continuously moved through said twisting zone while having twist imparted thereto by frictional contact between the yarn and the respective opposed friction surfaces resulting from the force exerted by the biasing means and while the yarn engaging friction surfaces remain in substantially non-contacting relationship with respect to each other.

38. The yarn false twisting apparatus as defined in claim 37 wherein said free end of said piston is in the form of an open skirt, and said air conveying means includes first air duct means for biasing said piston toward said other face and second air duct means for directing pressurized air into the interior of said skirt.

39. The yarn false twisting apparatus as defined in claim 38 wherein the peripheral rim of said open skirt includes a labyrinth-like series of recesses for reducing the loss of air outwardly between the open skirt and said other face of the belt.

40. The yarn false twisting apparatus as defined in claim 37 wherein said air conveying means includes means for feeding a highly dispersed liquid lubricant with the air between the free end of said piston and said other face of said belt.

41. The yarn false twisting apparatus as defined in claim 37 wherein the free end of said piston is in the form of an air distribution chamber having a lower pressure surface, with said lower pressure surface being air permeable, and wherein said air conveying means includes first air duct means for biasing said piston toward said other face and second air duct means for directing pressurized air into the interior of said air distribution chamber.

42. The yarn false twisting apparatus as defined in claim 41 wherein said lower pressure surface of said air distribution chamber is relatively long and narrow, and is aligned with the path of the yarn through said twisting zone.

43. The yarn false twisting apparatus as defined in claim 41 wherein said air distribution chamber is in the form of an annular ring, and includes air permeable means communicating between the ring and the lower pressure surface.

44. A yarn false twisting apparatus comprising a pair of twist imparting members, at least one of said members comprising a flexible endless belt having inner and outer faces, with one of said faces defining a yarn engaging friction surface, and with the other of said twist imparting members also including a yarn engaging friction surface, means mounting said members for rotational movement wherein portions of the respective yarn engaging friction surfaces are disposed in opposing, substantially non-contacting relationship and define therebetween a twisting zone for accommodating a running yarn, means for rotating each of said members such that their respective yarn engaging friction surfaces run in different directions through said twisting zone, and means operatively mounted adjacent the face of said belt opposite its yarn engaging friction surface for locally biasing said belt toward the other member only at said twisting zone and without generating substantial friction between said biasing means and belt, said biasing means comprising an elongate tubular member having a free end, means adjustably mounting said tubular member such that said free end directly overlies the adjacent face of said belt and the distance between said free end and adjacent face may be varied, and means for supplying pressurized air to said tubular member whereby an air cushion is formed between said free end and the adjacent face, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

45. A yarn false twisting apparatus comprising first and second twist imparting flexible endless belts, with each belt having inner and outer faces, and with one face of each belt defining a yarn engaging friction surface, means mounting said belts at a predetermined angle with respect to each other and for rotational movement wherein portions of the respective yarn engaging friction surfaces are disposed in opposing, substantially non-contacting relationship and define therebetween a twisting zone for accommodating a running yarn, means for guiding a running yarn through said twisting zone to define a yarn path therethrough, means for rotating each of said belts such that their respective yarn engaging friction surfaces run in different directions through said twisting zone, and means operatively mounted adjacent the other face of at least one of said belts for locally biasing said one belt toward the other belt only at said twisting zone and such that the biasing force is substantially limited to an area which is coincident to the path of the running yarn, whereby a yarn may be continuously moved through said twisting zone while having twist imparted thereto by frictional contact between the yarn and the respective opposed friction surfaces resulting from the force exerted by the biasing means, and while the yarn engaging friction surfaces remain in substantially non-contacting relationship with respect to each other.

46. The yarn false twisting apparatus as defined in claim 45 wherein said biasing means includes a roller having an arcuately curved surface in cross section, and such that said one belt is transversely curved at said twisting zone by said roller to present a convex surface toward the running yarn.

* * * * *